US010347077B2

(12) United States Patent
Arnone et al.

(10) Patent No.: US 10,347,077 B2
(45) Date of Patent: Jul. 9, 2019

(54) HYBRID GAME ELEMENT MANAGEMENT

(71) Applicant: Gamblit Gaming, LLC, Glendale, CA (US)

(72) Inventors: Miles Arnone, Sherborn, MA (US); Eric Meyerhofer, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 15/272,318

(22) Filed: Sep. 21, 2016

(65) Prior Publication Data

US 2017/0011586 A1 Jan. 12, 2017

Related U.S. Application Data

(63) Continuation of application No. 13/886,245, filed on May 2, 2013, now abandoned, which is a continuation (Continued)

(51) Int. Cl.
*G07F 17/32* (2006.01)

(52) U.S. Cl.
CPC ..... *G07F 17/3225* (2013.01); *G07F 17/32* (2013.01); *G07F 17/3209* (2013.01); *G07F 17/3211* (2013.01); *G07F 17/3244* (2013.01); *G07F 17/3288* (2013.01); *G07F 17/3295* (2013.01)

(58) Field of Classification Search
CPC ..... G07F 17/32
See application file for complete search history.

(56) References Cited

U.S. PATENT DOCUMENTS 5,413,357 A 5/1995 Schulze et al.
5,718,429 A 2/1998 Keller (Continued)

FOREIGN PATENT DOCUMENTS

JP 2001300098 10/2001
JP 2001300098 A 10/2001

(Continued)

OTHER PUBLICATIONS

U.S. Appl. No. 14/205,303 Arnone, et al., filed Mar. 11, 2014.

(Continued)

*Primary Examiner* — James S. McClellan
*Assistant Examiner* — Syvila Weatherford
(74) *Attorney, Agent, or Firm* — Frank Cire; Caitlyn Ross

(57) ABSTRACT

An electronic gaming machine constructed to receive real credits, including a real world engine configured to provide a randomly generated payout for a gambling game and a game world engine configured to manage an entertainment software engine to provide outcomes based upon a player's skillful execution of an entertainment game are provided. In operation, an amount of real world credits are wagered in the real world engine, a randomly generated payout of real world credits is determined based upon the wagered amount using the real world engine, a number of elements are added that are ascribed to a player and that are scaled according to a scaling ratio set by the game world engine relative to the payout of real world credits using the game world engine.

7 Claims, 6 Drawing Sheets

Related U.S. Application Data of application No. PCT/US2012/046551, filed on Jul. 12, 2012.

(60) Provisional application No. 61/572,134, filed on Jul. 12, 2011.

(56) References Cited

U.S. PATENT DOCUMENTS 5,785,592 A 7/1998 Jacobsen
5,853,324 A 12/1998 Kami et al.
5,963,745 A 10/1999 Collins et al.
6,050,865 A 4/2000 Bohmann
6,050,895 A 4/2000 Luciano
6,165,071 A 12/2000 Weiss
6,227,974 B1 5/2001 Eilat
6,267,669 B1 7/2001 Luciano
6,616,531 B1 * 9/2003 Mullins ..... A63F 3/00157 273/269
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Amone
8,480,470 B2 7/2013 Napolitano et al.
8,622,809 B1 1/2014 Arora et al.
8,864,564 B2 10/2014 Oberberger
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0160825 A1 10/2002 NiCastro
2002/0218590 10/2002 O'Halloran
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0218590 A1 10/2005 O'Halloran
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 * 5/2008 Oberberger ..... G07F 17/32 463/16
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar

(56) References Cited

U.S. PATENT DOCUMENTS

2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124327 A1* 5/2009 Caputo ..... G07F 17/3244 463/20
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0247272 A1 8/2009 Abe
2009/0221355 A1 9/2009 Dunaevsky et al.
2009/0239610 A1 9/2009 Olive
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0285869 A1 11/2010 Walker
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gergon
2011/0045896 A1 2/2011 Yak et al.
2011/0070945 A1 3/2011 Walker
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0111820 A1 5/2011 Filipour
2011/0111837 A1 5/2011 Gagner
2011/0111841 A1 5/2011 Tessmer
2011/0118011 A1 5/2011 Filipour et al.
2011/0109454 A1 6/2011 McSheffrey
2011/0201413 A1 8/2011 Oberberger
2011/0207523 A1 8/2011 Filipour et al.
2011/0218028 A1 8/2011 Acres
2011/0212766 A1 9/2011 Bowers et al.
2011/0212767 A1 9/2011 Barclay
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wicket
2013/0131848 A1 5/2013 Arnone et al.
2013/0190074 A1 7/2013 Arnone et al.
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.
2014/0357350 A1 12/2014 Weingardt et al.

FOREIGN PATENT DOCUMENTS

JP 2003111980 A 4/2003
JP 2004097610 A 4/2004
JP 2004166746 6/2004
JP 2004166746 A 6/2004
JP 2008119469 A 5/2008
JP 2009253305 10/2009
JP 20011232515 A 11/2011
WO 9851384 A1 11/1998
WO 2006023907 A2 3/2006
WO 2010087090 A1 8/2010
WO 2011109454 A1 9/2011
WO 2012078668 A1 6/2012
WO 2012139083 A1 10/2012
WO 2012/167275 A2 12/2012
WO 2012167146 A1 12/2012

OTHER PUBLICATIONS

U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.

(56) References Cited

OTHER PUBLICATIONS

U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.
IP Australia, Patent Examination Report No. 2, Patent Application No. 2012281063, dated Aug. 10, 2015.
Japan Patent Office, First Office Action, Japan Patent Application No. 2014-520342, dated Aug. 3, 2016.
Intellectual Property Office of Singapore Search Report and Written Opinion, IPOS Application No. 2014000939, dated Apr. 10, 2015.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 17, 2016.
U.S. Appl. No. 15/233,294 Arnone, et al. filed Aug. 24, 2016.
U.S. Appl. No. 15/241,683 Arnone, et al. filed Sep. 1, 2016.
International Preliminary Report on Patentability, PCT/US2012/046551, dated Jun. 14, 2013.
itl.nist.gov, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.
Changing the Virtual Self: Avatar Transformations in Popular Games; Barr et al., Victoria Univ., NZ, 2006.
Real-Time Multimodal Human-Avatar Interaction; Li et al., IEEE (Video Technology) vol. 18, No. 4, 2008.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.

(56) References Cited

OTHER PUBLICATIONS

U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
Japan Patent Office, Second Office Action, Japan Patent Application No. 2014-520342, dated Jun. 6, 2017.
IP Australia, Patent Examination Report No. 1, Patent Application No. 2012281063, dated Aug. 10, 2015.
International Search Report and Written Opinion, PCT/US2012/046551, dated Oct. 4, 2012.

* cited by examiner

100

HYBRID GAME ELEMENT MANAGEMENT

CROSS REFERENCE TO RELATED APPLICATIONS

This application is a continuation of U.S. patent application Ser. No. 13/886,245, filed May 2, 2013, which is a continuation of PCT/US2012/046551, filed Jul. 12, 2012, which claims the priority of U.S. Provisional Application No. 61/572,134, filed Jul. 12, 2011, the contents of each of which are hereby incorporated by reference as if stated in full herein.

FIELD OF THE INVENTION

The present invention is generally related to gaming and more specifically to managing elements in a hybrid game that includes both a gambling game and an entertainment game.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game may depend upon a player's skill with the game. Gambling games are typically not as interactive and do not include graphics as sophisticated as an entertainment game, which is a game of skill such as a video game.

SUMMARY OF THE INVENTION

Methods and systems for operating a hybrid game that comprises a real world engine constructed to provide a randomly generated payout for a gambling game and a game world engine constructed to manage an entertainment software engine to provide outcomes based upon a player's skillful execution of an entertainment game are provided.

In various exemplary embodiments, an amount of real world credits are wagered in the real world engine, a randomly generated payout of real world credits is determined based upon the wagered amount using the real world engine, a number of elements adding that are ascribed to a player and that are scaled according to a scaling ratio set by the game world engine relative to the payout of real world credits using the game world engine, and the elements are divided according to a division ratio set by the game world engine into enabling elements ascribed to the player capable of immediate use in the entertainment game and reserve enabling elements ascribed to the player but incapable of immediate use in the entertainment game using the game world engine, wherein the elements are limited resources utilized within the entertainment game to advance gameplay.

In numerous exemplary embodiments, reserve enabling elements are converted to enabling elements in response to a predetermined accomplishment in the entertainment game using the game world engine.

In various exemplary embodiments, the entertainment software engine is constructed to display the enabling elements and the reserve enabling elements via a user interface.

In several exemplary embodiments, elements ascribed to a player are stored in the game world engine for later use.

In many exemplary embodiments, the wagering of an amount of real world credits is performed in response to consuming an amount of enabling elements in the entertainment game.

In numerous exemplary embodiments, the total number of elements is capped.

In various exemplary embodiments, elements are soldiers in an entertainment game.

In several exemplary embodiments, the elements are bullets in an entertainment game.

In many exemplary embodiments, an amount of game world credits are wagered in the game world engine, a randomly generated payout of game world credits is determined based upon the wagered amount using the game world engine, a number of elements are added and are ascribed to a player that is scaled relative to the payout of game world credits using the game world engine, and the elements are divided into enabling elements and reserve enabling elements using the game world engine.

DETAILED DESCRIPTION

Figure 1:
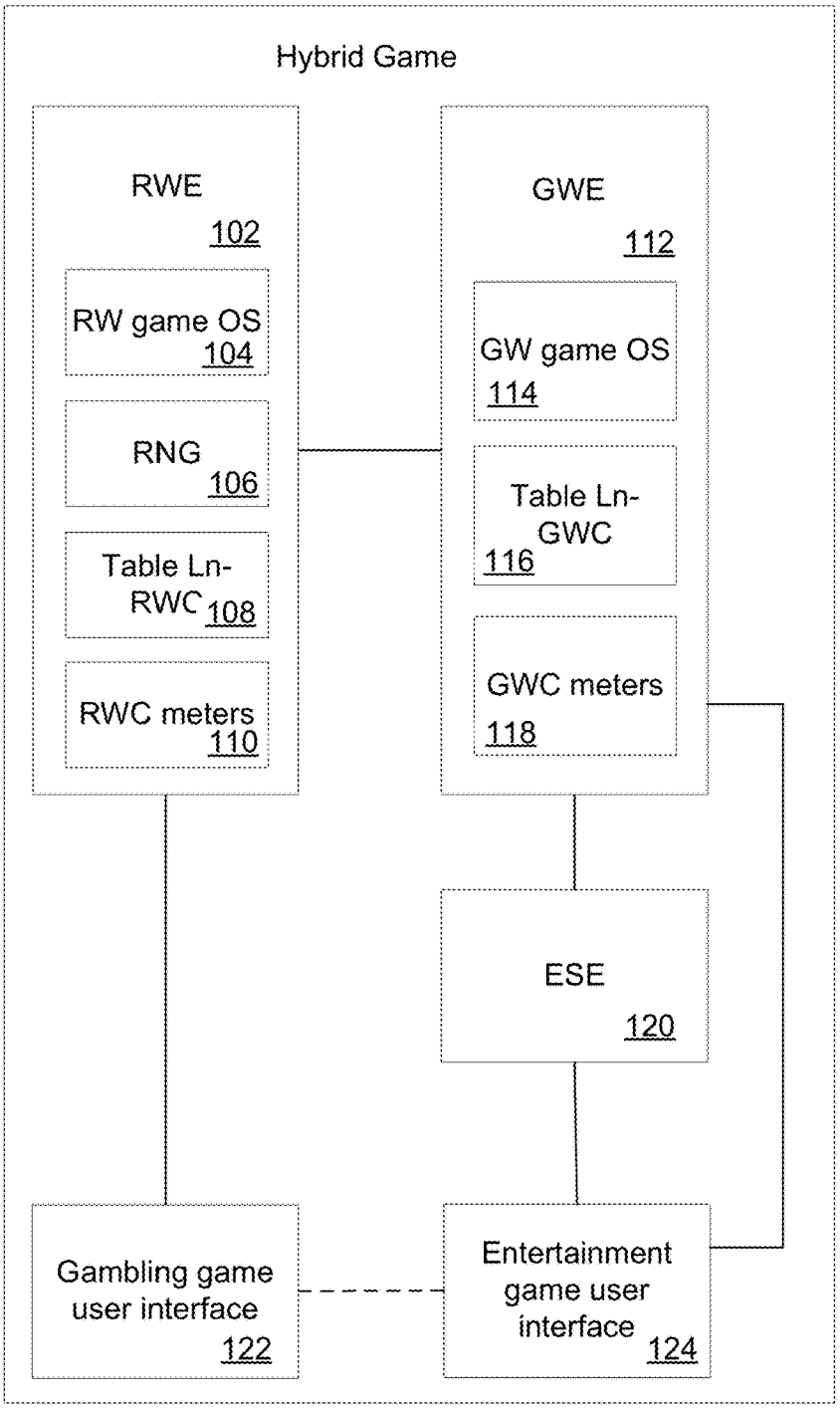
FIG. 1 illustrates a hybrid game with element management in accordance with an embodiment of the invention.

Turning now to the drawings, systems and methods for a hybrid game that include element management are illustrated. In many embodiments, both enabling elements (EE) and reserve enabling elements (REE) are managed using element management processes. Elements are entertainment game gameplay limited resources that are utilized during the performance of the entertainment game in order to advance gameplay. In many embodiments, elements include but are not limited to ammunition, such as bullets, used in a shooting entertainment game involving shooting a gun, money in a real estate entertainment game involving the purchase of properties, or soldiers in a war entertainment game involving commanding a number of soldiers in battles. Enabling elements are elements available for immediate use, such as bullets that may immediately be fired, money that may immediately be used to purchase properties, or soldiers that may immediately be deployed during gameplay. Reserve enabling elements are enabling elements that are ascribed to a player but incapable of immediate use by conversion to an enabling element due to element management.

In several embodiments, a hybrid game is a game that integrates both a gambling game that includes a real world engine (RWE) which manages the gambling game, as well as an entertainment game that includes a game world engine (GWE) which manages the entertainment portion of a game, and an entertainment software engine (ESE) which executes the game for user entertainment. In certain embodiments, the hybrid game also includes a user interface associated with either or both the gambling game and the entertainment game. Various hybrid games are discussed in Patent Cooperation Treaty Application No. PCT/US11/26768, filed Mar. 1, 2011, entitled "ENRICHED GAME PLAY ENVIRONMENT (SINGLE and/or MULTI-PLAYER) FOR CASINO APPLICATIONS" and Patent Cooperation Treaty Application No. PCT/US11/63587, filed Dec. 6, 2011, entitled "ENHANCED SLOT-MACHINE FOR CASINO APPLICATIONS" each disclosure of which is hereby incorporated by reference in its entirety. In a number of embodiments, element management processes are performed by a game world engine (GWE) managing an entertainment software engine (ESE).

In many embodiments, element management processes performed by a GWE determine the relationship between elements of an entertainment game and real world credits (RWC) of a gambling game. Real world credits are credits used by the gambling game of a hybrid game, such as money used in a wager. In several embodiments, the amount of real world credits accumulated in a gambling game may be correlated with an accumulation of elements in an entertainment game. This can apply to a payout in a gambling game in a case where a wager in the gambling game may increase the amount of Real World Credit (RWC) available to a player though a payout and increase the number of elements as a corollary. In several embodiments, elements of an entertainment game and RWC of gambling game can be synchronized, such that as EE is utilized, a proportional amount of RWC is wagered in the gambling game for a payout. In certain embodiments, the payout of real world credits in a gambling game can be so great, such as through a jackpot payout which provides a payout that increases the wagered RWC by an upper limit of possible payouts, that a corresponding increase of elements in an entertainment game would render the entertainment game practically unplayable by rendering other players in a multiplayer entertainment game at a significant disadvantage (such as by changing what otherwise would be a limited amount of elements into a practically unlimited amount of elements). Therefore, in many embodiments, element management processes determine the relationship between RWC and elements to maintain the fairness of entertainment game play using processes including (but not limited to) processes that scale the elements relative to the RWC available and/or divide the elements into EE and REE relative to the RWC available. In the context of element management processes, the term "scaling" can be used to refer to processes that determine an appropriate ratio for adjusting the number of elements added relative to the number of RWC added (such as during a wager's payout). The term "dividing" can be used to refer to processes that determine the appropriation of elements into EE and REE relative to RWC.

Although specific hybrid games with element management are discussed above, hybrid games can utilize any of a variety of element management processes appropriate to the requirements of a specific application in accordance with embodiments of the invention. Hybrid games that perform element management processes in accordance with embodiments of the invention are discussed further below.

Hybrid Games

In many embodiments, a hybrid game provides players with high levels of entertainment content with a game of skill in their gambling experience. These hybrid games provide for a random outcome independent of player skill while ensuring that the user's gaming experience (as measured by obstacles/challenges encountered, time of play and other factors) is shaped by the player's skill. A hybrid game capable of performing element management processes in accordance with an embodiment of the invention is illustrated in FIG. 1. The hybrid game includes a RWE 102, GWE 112, ESE 120, gambling game user interface 122 and entertainment game user interface 124. The two user interfaces may be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In several embodiments, The RWE 102 is the fundamental operating system for the gambling game of the hybrid game and controls and operates the gambling game. The operation of a gambling game is enabled by money, such as real funds, accretes and declinates real gambling credits based on random gambling outcome, and whose gambling proposition is typically regulated by gaming control bodies. In many embodiments, the RWE includes a RW operating system (OS) 104, random number generator (RNG) 106, level "n" real-world credit pay tables (Table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithm and/or processes, which are used to generate random outcomes. A level n real-world credit pay table (Table Ln-RWC) 108 is a table that can be used in conjunction with a random number generator (RNG) 106 to dictate the real world credits (RWC) earned as a function of game play and is analogous to the pay tables used in a conventional slot machine. Table Ln-RWC payouts are independent of player skill. There may be one or a plurality of Table Ln-RWC pay tables 108 contained in a gambling game, the selection of which may be determined by factors including (but not limited to) game progress a player has earned, and/or bonus rounds which a player may be eligible for. Real world credits (RWC) are credits analogous to slot machine game credits, which are entered into a gambling game by the user, either in the form of money such as hard currency or electronic funds. RWCs can be decremented or augmented based on the outcome of a random number generator according to the Table Ln-RWC real world credits pay table 108, independent of player skill. In certain embodiments, an amount of RWC can be required to enter higher ESE game levels. RWC can be carried forward to higher game levels or paid out if a game cash out is opted for by a player. The amount of RWC required to enter a specific level of the game "level n" need not be the same for each level.

In many embodiments, the GWE 112 manages the overall hybrid game operation, with the RWE 102 and the ESE 120 effectively being support units to the GWE 112. In several embodiments, the GWE 112 contains mechanical, electronic and software system for an entertainment game. The GWE 112 includes a GW game operating system (OS) 114 that provides control of the entertainment game. The GWE additionally contains a level "n" game world credit pay table (Table Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120.

In many embodiments, a level "n" game world credit pay table (Table Ln-GWC) 116 dictates the GWC earned as a function of player skill in the nth level of the game. The payouts governed by this table are dependent upon player skill and game play at large and may or may not be coupled to a random number generator. In several embodiments, game world credits (GWC) are player points earned or depleted as a function of player skill, i.e. as a function of player performance in the context of the game. GWC is analogous to the "score" in a typical video game. Each game has one or more scoring criterion, embedded within the Table Ln-GWC 116 that reflects player performance against the goal(s) of the game. GWC can be carried forward from one level of game play to another, and ultimately paid out in various manners such as directly in cash, or indirectly such as earning entrance into a sweepstakes drawing, or earning participation in, or victory in, a tournament with prizes. GWC may be stored on a player tracking card or in a network-based player tracking system, where the GWC is attributed to a specific player.

In certain embodiments, the operation of the GWE does not affect the RWE's gambling operation except for player choice parameters that are allowable in slot machines today including but not limited to the wager amount, how fast the player wants to play (by pressing a button or pulling the slot's handle) and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a necessary status operation of the RWE (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the player's user interface directly, as this may be necessary to communicate certain entertainment game club points, player status, control the selection of choices and messages which a player may find useful in order to adjust their entertainment game experience or understand their gambling status in the RWE 102.

In various embodiments, the ESE 120 manages and controls the visual, audio, and player control for the entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWE 112. In certain embodiments, control information to the ESE 120 from the GWE 112 includes information used by element management processes. In several embodiments an ESE 120 can be implement using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific game program.

The ESE 120 operates mostly independent from the GWE 112, except that via the interface, the GWE 112 may send certain GW game control parameters to the ESE 120 to affect its play, such as (but not limited to) what level of character to be using, changing the difficulty level of the game, changing the type of gun or car in use, and/or requesting potions to become available or to be found by the character. In certain embodiments, the GWE 112 can perform element management processes by determining the scaling and division of elements into EE and REE as correlated to RWC and/or GWC. The ESE 120 can accept this input from the GWE 112, make adjustments, and continue the play action all the while running seamlessly from the player's perspective. The ESE's operation is mostly skill based, except for where the ESE's algorithm may inject complexities into the game by chance in its normal operation to create unpredictability in the entertainment game. Utilizing this interface, the ESE 120 may also communicate player choices made in the game to the GWE 112, such as but not limited to selection of a different gun, and/or the player picking up a special potion in the GW environment. The GWE's job in this architecture, being interfaced thusly to the ESE 120, is to allow the transparent coupling of entertainment software to a fair and transparent random chance gambling game, providing a seamless perspective to the player that they are playing a typical popular entertainment game (which is skill based). In certain embodiments, the ESE 120 can be used to enable a wide range of games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In several embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of games per minute the RWE 102 can execute, entrance into a bonus round, and other factors, all the while these factors can take a different form than that of a typical slot machine. An example of a varying wager amount that the player can choose might be that they have decided to play with a more powerful character in the game, a more powerful gun, or a better car. These choices can increase or decrease the amount wagered per individual gambling game, in the same manner that a standard slot machine player may decide to wager more or less credits for each pull of the handle. In several embodiments, the RWE 102 can communicate a number of factors back and forth to the GWE 112, via an interface, such increase/decrease in wager being a function of the player's decision making as to their operational profile in the entertainment game (i.e. power of the character, gun selection, car choice, etc.). In this manner, the player is always in control of the per game wager amount, with the choice mapping to some parameter or component that is applicable to the entertainment game experience of the hybrid game. In a particular embodiment, the RWE 102 operation can be a game of chance running every 10 seconds where the amount wagered is communicated from the GWE 112 as a function of choices the player makes in the operation profile in the entertainment game such as those cited above.

In many embodiments, a hybrid game integrates a video game style gambling machine, where the gambling game (i.e. RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance, such as a slot machine, is preserved. At the same time a rich environment of rewards to stimulate "garners" can be established with the entertainment game. In several embodiments, the hybrid game can leverage very popular titles with "garners" and provides a sea change environment for casinos to attract players with games that are more akin to the type of entertainment which a younger generation desires. In various embodiments, players can use their skill towards building and banking GWC which in turn can be used to win tournaments and various prizes as a function of their "gamer" prowess. Numerous embodiments minimize the underlying changes needed to the aforementioned entertainment software (Gears of War, etc.), for the hybrid game to operate within an entertainment game construct, thus making a plethora of complex game titles and environments, rapid and inexpensive to deploy in a gambling environment.

In certain embodiments, hybrid games also allow players to gain entry into subsequent competitions through the accumulation of game world credits (GWC) that accrue as a function of the user's demonstrated skill at the game. These competitions can pit individual players or groups of players against one another and/or against the casino to win prizes based upon a combination of chance and skill. These competitions may be either asynchronous events, whereby players participate at a time and/or place of their choosing, or they may be synchronized events, whereby players participate at a specific time and/or venue. In various embodiments, the accumulation of GWC can also be related to the elements of the entertainment game and therefore element management processes may determine the relationship between the GWC and elements.

Although hybrid games configured to perform element management processes are discussed above, any or a variety of hybrid games can be implemented that can perform element management processes as appropriate to the requirements of a specific application in accordance with embodiments of the invention. Relationships between RWCs, GWCs and elements are discussed further below.

Relationships between RWC, GWC and Elements

Figure 2:
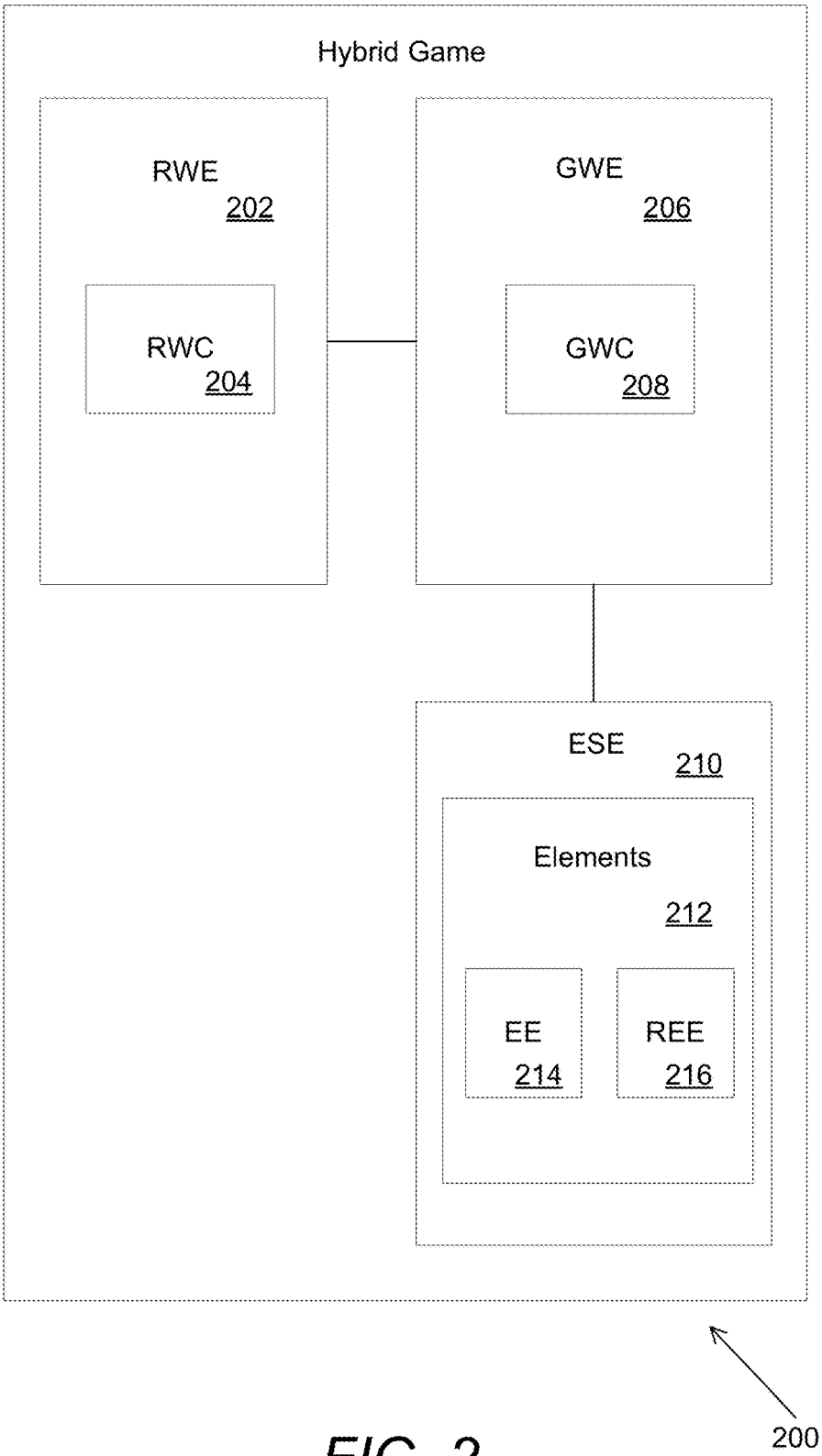
FIG. 2 illustrates a relationship between real world credits (RWC), game world credits (GWC) and elements in a hybrid game with element management in accordance with an embodiment of the invention.

Elements used within an entertainment game may be adjusted relative to RWC or GWC in a hybrid game. A hybrid game configured to perform element management processes that adjust elements within an entertainment game based upon RWC, and/or GWC in according to an embodiment of the invention is illustrated in FIG. 2. The hybrid game 200 includes RWC 204 maintained in a RWE 202. The RWE 202 is connected with a GWE 206, which maintains GWC 208. The GWE 206 is connected with an ESE 210, which maintains information concerning elements 212 in an entertainment game within the hybrid game. These elements 212 can include both EE 214 and REE 216.

In many embodiments, element management processes performed by a GWE can relate the quantity of RWC 204 in a gambling game 200 to the elements 212 used in an entertainment game as executed by an ESE 210. In several embodiments, element management processes can also determine a relationship between the GWC 208 and the elements 212 in the entertainment game of a hybrid game as well. Although specific relationships between RWC, GWC and elements of a hybrid game for element management processes are discussed above, a hybrid game may be implemented that utilizes element management processes in various different ways according to the requirements of a specific application in accordance with embodiments of the invention. A process for element management is discussed further below.

Element Management Processes

Figure 3:
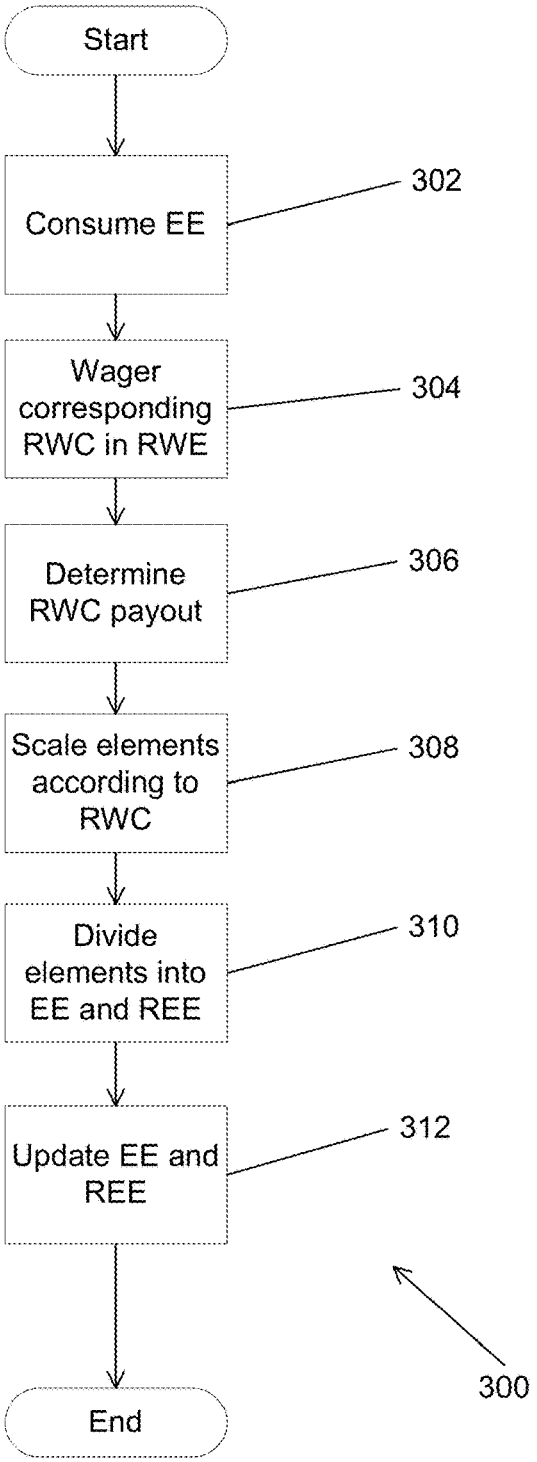
FIG. 3 illustrates a process using element management in accordance with an embodiment of the invention.

Element management processes in accordance with many embodiments of the invention may be implemented by scaling elements according to the quantity of RWC in a gambling game and dividing the elements into both EE and REE. An element management process in accordance with an embodiment of the invention is illustrated in FIG. 3. The process 300 includes consuming (302) EE. EE may be consumed in an entertainment game in a variety of ways related to the entertainment game of the hybrid game such as but not limited to by consuming ammunition by shooting "bullets" in a shooting game or by deploying troops in a war game. After consuming (302) EE, corresponding RWC in an RWE is wagered (304). In certain embodiments, a wager of EE correlates to a consumption of an amount of RWC, such as where the consumption of ammunition by shooting "bullets" in a shooting game wagers a certain amount of RWC in a gambling game of a hybrid game. In many embodiments, the entertainment game is triggered as the enabling element is consumed in direct correlation and simultaneously with consumption of correlated RWC. The GWC is then augmented or reduced as appropriate. After wagering (304) RWC, a RWC payout is determined (306) according to the wager. After determining (306) the RWC payout, the elements are scaled (308) according to the RWC now available including the existing RWC and the newly added RWC from the RWC payout. The elements can also be divided (310) into EE and REE. The elements are then updated (312) to be available for use in the entertainment game.

In many embodiments, element management processes which manage REE in additional to EE allow the amount of EE available for consumption in the entertainment game to be controlled within allowable ranges to ensure a high level of playability. In several embodiments, element management processes include scaling of elements relative to RWC, which controls the amount of contribution that RWC payouts make to elements. In a number of embodiments, element management processes include a division of elements into EE and REE. The usage of scaling and division in element management processes are primarily intended for use where elements are accumulated directly as a function of entertainment game play, and not to be accumulated in a quantity deemed to inordinately skew the entertainment game from means outside of the entertainment game itself to ensure playability of the game.

In certain embodiments, an increase in RWC (for example from winning a wager, or putting additional credits into a gambling game) or EE due to some game event or feat performed by the player, would be subject to scaling to determine the amount of elements allowed to a player due to a change in RWC according to an exchange ratio between RWC accumulated and elements accumulated. Following this, an appropriate division of the elements into EE and REE can be performed. In certain embodiments, if 100 RWC were won as a function of a jackpot, the hybrid game for a particular type of entertainment game can scale the change in RWC by determining that only a 50% contribution should be used from the won RWC, yielding a contribution of 50 units of elements. From there, the hybrid game can further divide the elements into EE and REE by determining that only 10 units can be contributed to EE, and the balance of 40 can be contributed to REE. In several embodiments, the two aforementioned operations of scaling and division are not necessarily linear in nature. In several embodiments, element management processes can be performed with a feedback loop where the scaling and/or division of elements into EE and REE due to a change in RWC (such as through a RWC payout) is also dependent upon the elements available in an entertainment game. For example, a feedback loop may incorporate a detection of the pool of the player's available EE and Reserve EE. In numerous embodiments, this feedback would be incorporated in the formula for determining contribution scaling, or the contribution division, or both.

In numerous embodiments, a number of game parameters can be used as factors in element management processes. These game parameters may include but are not limited to: the game level or game stage, physical game time elapsed since the game start or a game event, game (virtual) time elapsed since the game start of a game event, the amount of GWC a player has accumulated since the game start or a game event, the amount of GWC a player possesses, the amount of RWC a player has accumulated since the game start or a game event, the amount of RWC a player possesses, the rate of consumption of RWC, the rate at which RWC is added to the game, the amount of RWC added to the game, settings determined by the player through the insertion of cash or some other game crediting means, in-game entertainment variables and events, in-game feats performed by the player, the rate of increase or decrease of a player's EE over time or between events, the rate of increase or decrease of a player's REE over time or between events, and other algorithms or formulae operating within the hybrid game and/or the GWE and ESE.

In many embodiments, REE are captive, potentially available resources for the player so long as these resources can be unlocked. REEs are tangible in a hybrid game as being tracked, accounted for, made visible to the player, and are fungible for EE in the game as permitted by the hybrid game. REE in combination with EE, therefore, establishes a ceiling for the amount of total elements that a player can deploy during play of the entertainment game. In certain embodiments, where elements are cash, homes or other assets used in a real estate type game (such as one based off the Monopoly board game published by Hasbro based out of Pawtucket, R.I., USA), a player may have a $1,000 monopoly dollar cap on EE, and a REE cap of $4,000 monopoly dollars, the most cash a player will be able to accumulate under any circumstances is $5,000 monopoly dollars. In several embodiments, REE is appropriated when an amount of elements added due to an increase in RWC exceeds the limit of the amount of EE allowed for a user during gameplay.

In many embodiments, REE can have a cap. Additional contributions, which could no longer be allocated to EE or REE because both had reached a cap could (without limitation) be discarded with or without notification to the player, require a player to cash-out to terminate the game session, be exchanged for GWC in some ratio or according to a formula, be fed back as additional RWC for the player in some ratio or according to a formula, cause an automatic game adjustment allowing higher caps on EE and/or Reserve EE, trigger an automatic or player agreed upon up-shift in game stage, level or complexity, or be placed into the player's account for use in a later game session.

In many embodiments, EE can be augmented by transferring REE into EE even if additional EE has not been earned through entertainment game play. In certain embodiments, when a player's level of EE declines to a certain amount within the interactive game, a player is given the option to "reload" the EE by an amount equal to or less than a prescribed amount, depending upon the amount of REE currently available. The reloading of EE may be achieved by either a player action such as through a hard or soft button with appropriate labeling (e.g. "RELOAD", "FILL", "RENEW", etc.) or through a more interactive process by requiring a player to undertake and possibly successfully complete an act within the game (e.g. going to the ammunition dump, or traveling to the magic store to pick up more potions), or REE to EE transfer could be automatic. The number of times or the amount of REE can be transferred to EE can be unlimited, or can be limited by one or more variables in combination. The act of reloading EE may or may not carry with it an explicit charge in the form of RWC, EE and/or GWC. A non-exhaustive list of variables controlling REE to EE transfer would be: the game level or game stage, physical game time elapsed since the game start or a game event, game (virtual) time elapsed since the game start of a game event, the amount of GWC a player has accumulated since the game start or a game event, the amount of GWC a player possesses, the amount of RWC a player has accumulated since the game start or a game event, the amount of RWC a player possesses, the rate of consumption of RWC, the rate at which RWC is added to the game, the amount of RWC added to the game, by the player through the insertion of cash or some other game crediting means, in-game entertainment variables and events, in-game feats performed by the player, the amount of EE a player has, the amount of REE a player has, the rate of increase or decrease of a player's EE over time or between events, the rate of increase or decrease of a player's REE over time or between events, other algorithms or formulae operating within a hybrid game and/or the GWE and ESE, and the amount of times REE was funded to EE in a game session In many embodiments, one or more types or classes of EE may exist (such as in a shooting game, bullets and health points), and thus a correlated set of one or more REE can similarly exist (e.g. reserve bullets available, and reserve health recharge points available).

In several embodiments, EE or REE may be retained in a player account and accumulated over multiple play sessions, available for the day when a tournament or game space situation reaches a challenging level where the accumulated EE or REE could then be deployed. In a manner of speaking, REE accumulation, where permitted under certain embodiments, equates to the proverbial "rainy day" money.

In particular embodiments, EE and REE can be augmented as a function of entertainment game play and/or as a function of increases in the amount of RWC in the hybrid game. EE and REE can also be augmented via other means as well, including by the casino operator through mechanisms such as but not limited to player's clubs.

Although examples of element management processes in a hybrid game are discussed above, hybrid games can implement element management processes in various different ways according to the requirements of a specific application in accordance with embodiments of the invention. An example of a hybrid game employing element management processes within a war entertainment game is discussed below.

War Entertainment Game Example

Element management processes in accordance with many embodiments of the invention may be implemented in different types of hybrid games, including a hybrid game with a war type of entertainment game (such as based off the strategic board game "Risk" produced by Hasbro of Pawtucket, R.I., USA) that utilizes soldiers as elements. In various embodiments, players are appropriated troops as a function of the number of countries, continents, factories and capitals in their empire plus soldiers accumulated based on cards acquired in prior turns. Typically, players receive between three and forty soldiers per turn, and in no circumstance more than 100. These soldiers are then placed on the board and engaged in combat with the soldiers of other players or computer managed players. In particular embodiments, EE could be the soldiers placed on the board, and a relationship between EE and RWC can be structured so that a soldier placed on the board corresponds to a $1 wager in the gambling game. In the event that the gambling game can pay out a $100 payout on a $1 bet, and that the hybrid game allows a player to utilize the $100 payout to place 100 soldiers on the board, the additional 100 soldiers could dramatically distort the entertainment game and cause game play to operate outside the normal operating parameters expected by the entertainment game's designers. To the extent that the hybrid game was being played in a multiplayer mode, the other players could be severely disadvantaged and likely consider the entertainment game a flop.

In many element management processes, elements are scaled and/or divided into EE and REE relative to the RWC in a hybrid game. In certain embodiments, REE can correspond to the number of troops held in reserve in the barracks that the player may be able to deploy in the game at a later point but not immediately (as EE). Therefore, a sudden influx of elements due to an increase in payout of RWC from a wager would not severely disadvantage other players in a hybrid game.

Figure 4:
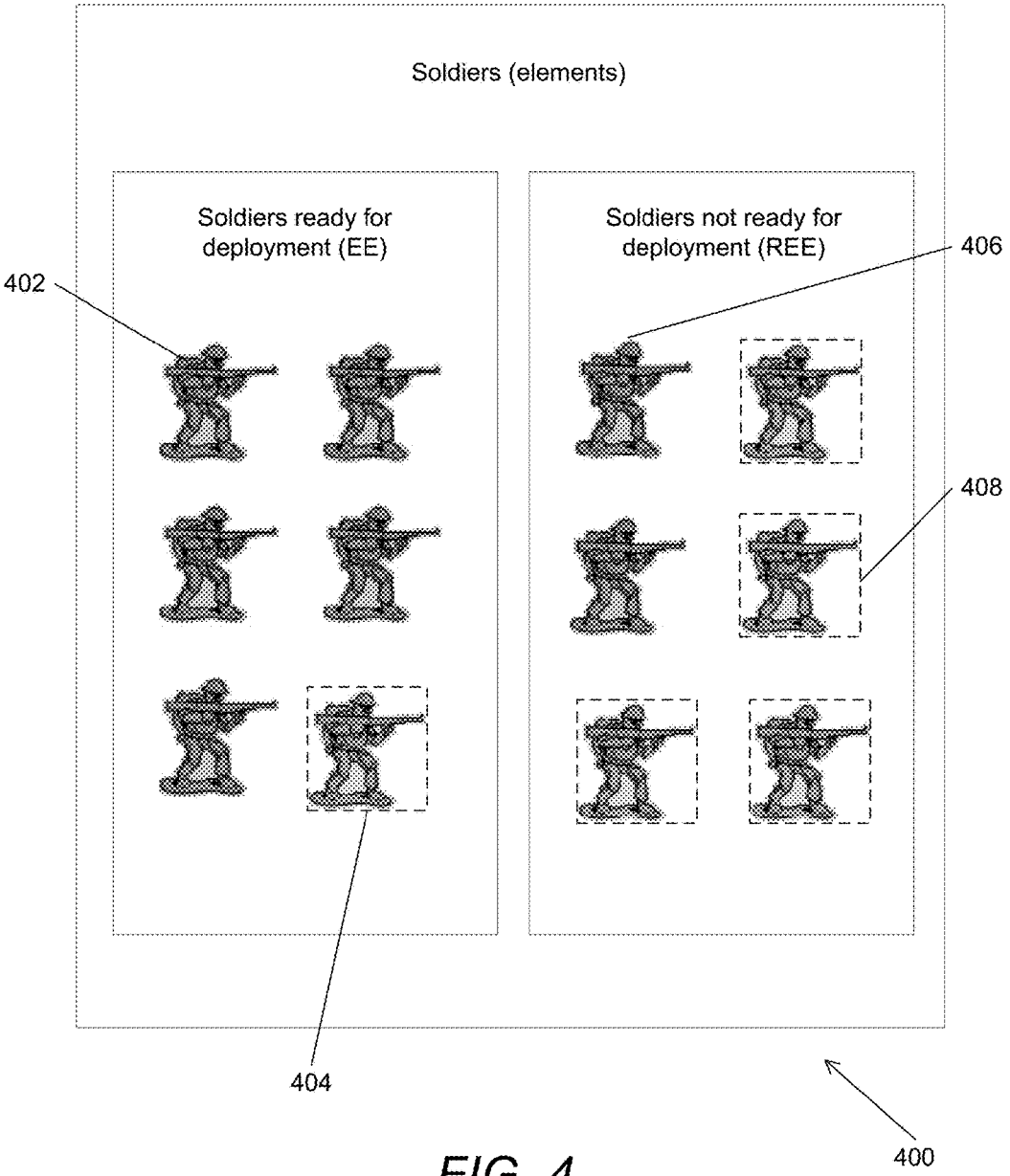
FIG. 4 illustrates a user interface illustrating enabling elements (EE) and reserve enabling elements (REE) for a war entertainment game in accordance with an embodiment of the invention.

A user interface illustrating EE and REE from a war entertainment game in accordance with an embodiment of the invention is illustrated in FIG. 4. In the user interface 400 of the war entertainment game there are five soldiers 402 ready for immediate deployment (EE) with one more space 404 available for a soldier that can be added to the number of soldiers ready for immediate deployment (as indicated by a soldier within a dotted line box). Also, the user interface indicates that there are two soldiers (406) not yet ready for deployment (REE) and four more spaces (408) available for soldiers not ready for immediate deployment (as indicated by a solider within a dotted line box).

In certain embodiments, criteria may be applied to determine if an element may be utilized immediately as EE or restricted to later use as REE. In several embodiments, soldiers (elements) are earned at the beginning of each player's turn as a function of the number of countries, factories, continents and soldier cards owned. However, as discussed above, particular criteria have to be satisfied in order to deploy the earned soldiers to the board immediately as EE as opposed to storing the soldiers as REE. These criteria can include but are not limited to requiring that there be adequate RWC in the gambling game of the hybrid game or that the player has adequate countries, factories, continents, etc. (i.e. assets) to deploy them immediately as EE. For example, if a player's assets at the beginning of his turn entitle him to twenty-six troops, but there are only twenty-two troops ready for immediate deployment (EE), he will only be able to put 22 troops on the board, unless other criteria are satisfied, such as by inserting additional credits (RC) into the Hybrid Game.

In various embodiments, the criteria utilized in element management processes to determine whether an element is immediately usable as EE or not can be dynamically determined or triggered based upon events that may occur during gameplay. For example, as game play progresses, a player may experience a severe diminution of elements, such that at the onset of her turn she is only entitled to place three soldiers on the board as EEs, even though she has eighteen soldiers in total (total number of elements). The hybrid game could permit the player to reload the amount of soldiers they can place on the board (EE) by 10, so long as she has less than 5 soldiers that she can place immediately as EE, and that the player can do this 3 times per game. Given that 3 soldiers is less than the trigger threshold of 5, a "REINFORCE" button on the screen may go from being grayed out to active. The player presses the button, and by doing so, his EE is increased to 13, and the REE (the number of troops not available for immediate use) is reduced to 5. The button again becomes inactive until the necessary condition for it to become active is again true. At this juncture, the player now has 13 EE, and can place these troops on the game board and continue play.

Although specific examples of a hybrid game including element management processes executing a war entertainment game are discussed above, a hybrid game can execute a war entertainment game in various different ways as appropriate to the requirements of a specific application in accordance with embodiments of the invention. A hybrid game with element management processes executing a shooter entertainment game is discussed below.

Shooter Entertainment Game Example

Element management in accordance with many embodiments of the invention may be implemented in different types of hybrid games, including a shooter entertainment game that utilizes bullets as elements. In numerous embodiments, similar to the war entertainment game discussion above, criteria may be applied to determine if an element may be utilized immediately as EE or is restricted to later use as REE. In various embodiments, playability considerations for a shooter entertainment game can dictate that a player has access only to those bullets (EE) found in the context of the entertainment game where REE is the amount of bullets that a player might have in reserve in a personal ammunition dump. Thereby, a condition for an element to become EE can be to harness the reserve ammunition in the dump (REE) by requiring the player to reach the ammunition dump to reload, which to converts REE into EE.

Figure 5:
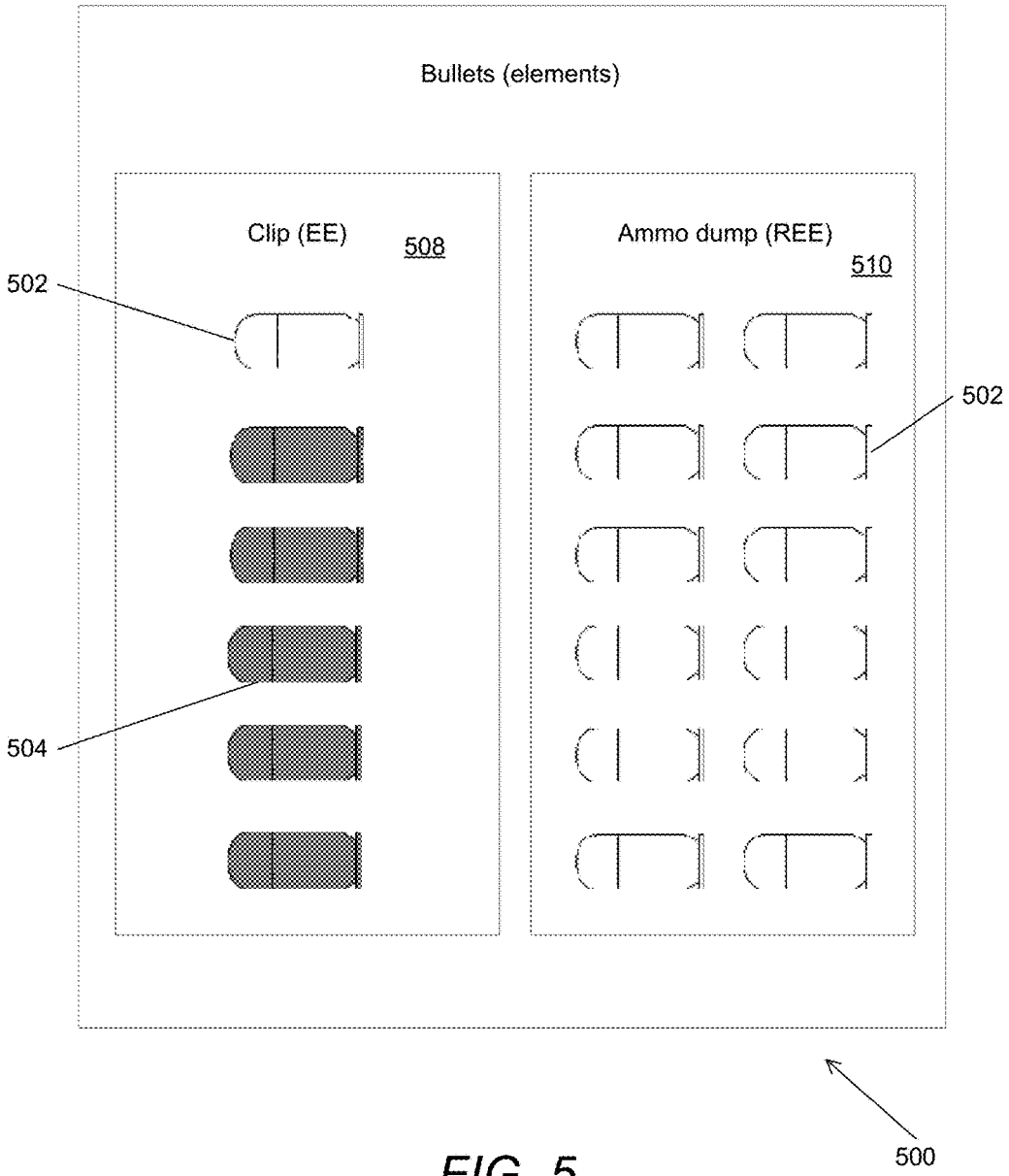
FIG. 5 illustrates a user interface illustrating EE and REE for a shooting entertainment game in accordance with an embodiment of the invention.

A user interface illustrating EE and REE from a shooter entertainment game in accordance with an embodiment of the invention is illustrated in FIG. 5. In the user interface of the shooter entertainment game 500, bullets in a clip 508 could be the elements available for immediate use as EE and bullets in an ammunition dump 510 could be the elements not available for immediate use as REE. In the illustrated embodiment, the dark shaded bullets 504 are bullets still available for immediate use and the outlined bullets 502 could represent bullets not available, whether for immediate use or not. In total, there are a total of 24 bullets (elements) that a player can hold. In certain embodiments, if 10 new bullets are contributed as a function of game performance or a payout from a wager of RWC, the first 2 bullets would be allocated to filling up the clip 508 (EE), and the remainder of 8 would be placed into the ammunition dump 510 (REE).

Although specific representations of elements as EE and REE are discussed above, any representation of EE and REE can be utilized as appropriate to a specific type of entertainment game in accordance with many embodiments of the invention. In several embodiments, REE and EE may be represented by numbers, such as "85 magazines" and "62 bullets", or "156 troop bunks" and "52 troops", or "Funds on Deposit: $8,000" and "Available Funds: $5,345". A discussion of processing apparatuses that can implement a hybrid game including element management processes is discussed below.

Processing Apparatus

Figure 6:
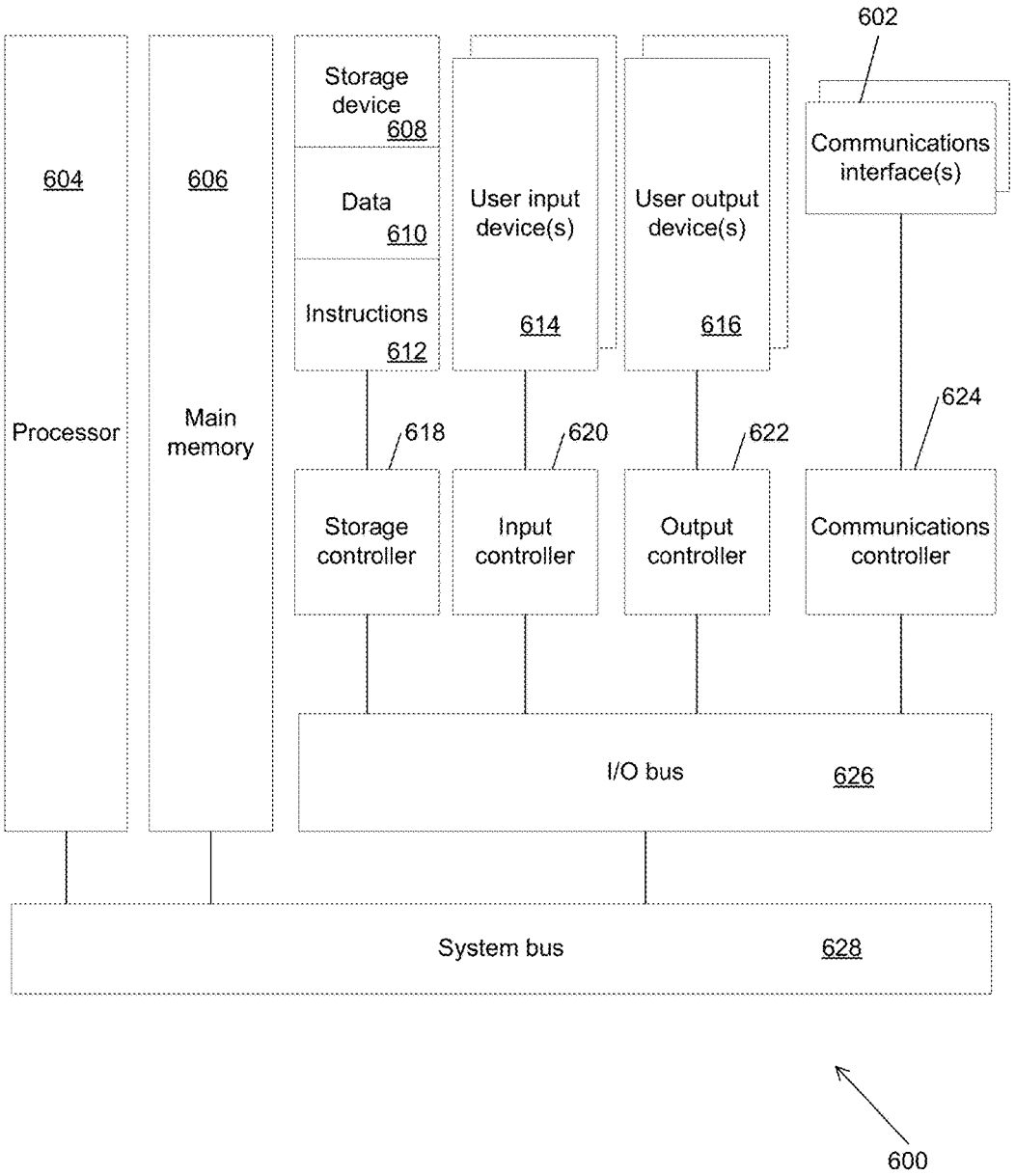
FIG. 6 illustrates a hardware architecture diagram of a processing apparatus in accordance with an embodiment of the invention.

Any of a variety of processing apparatuses can host various components of a hybrid game in accordance with embodiments of the invention. In several embodiments, these processing apparatuses can include, but are not limited to, a gaming machine, a general purpose computer, a computing device and/or a controller. A processing apparatus that is constructed to implement a hybrid game that performs element management processes in accordance with an embodiment of the invention is illustrated in FIG. 6. In the processing apparatus 600, a processor 604 is coupled to a memory 606 by a bus 628. The processor 604 is also coupled to non-transitory processor-readable storage media, such as a storage device 608 that stores processor-executable instructions 612 and data 610 through the system bus 628 to an I/O bus 626 through a storage controller 618. The processor 604 is also coupled to one or more interfaces that may be used to connect the processor to other processing apparatuses as well as networks as described herein. The processor 604 is also coupled via the bus to user input devices 614, such as tactile devices including but not limited to keyboards, keypads, foot pads, touch screens, and/or trackballs, as well as non-contact devices such as audio input devices, motion sensors and motion capture devices that the processing apparatus may use to receive inputs from a user when the user interacts with the processing apparatus. The processor 604 is connected to these user input devices 614 through the system bus 628, to the I/O bus 626 and through the input controller 620. The processor 604 is also coupled via the bus to user output devices 616 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 628 to the I/O bus 626 and through the output controller 622. The processor 604 can also be connected to a communications interface 602 from the system bus 628 to the I/O bus 626 through a communications controller 624.

In various embodiments, a processor loads the instructions and the data from the storage device into the memory and executes the instructions and operates on the data to implement the various aspects and features of the components of a gaming system as described herein. The processor uses the user input devices and the user output devices in accordance with the instructions and the data in order to create and operate user interfaces for players, casino operators, and/or owners as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an RWE, a GWE and an ESE as described herein can be implemented on multiple processing apparatuses, whether dedicated, shared or distributed in any combination thereof, or may be implemented on a single processing apparatus. In addition, while certain aspects and features of element management processes described herein have been attributed to an RWE, a GWE or an ESE, these aspects and features may be implemented in a hybrid form where any of the features or aspects may be performed by any of a RWE, GWE or ESE within a hybrid game without deviating from the spirit of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. An electronic gaming machine constructed to receive real world credits from a player, comprising:

at least one processor configured to provide a real world engine connected to at least one processor configured to provide a game world engine by a communication link, wherein the real world engine is constructed to:

receive from the game world engine via the communication link, a trigger for a wager of real world credits, wherein a wager payout is based on an outcome of a random number generator; and communicate to the game world engine via the communication link, the randomly generated payout of real world credits;

at least one processor configured to provide an entertainment software engine connected to the game world engine, the entertainment software engine constructed to:

provide an entertainment game to the player, the entertainment game including entertainment game outcomes based on actions taken by the player of utilization of an enabling element in the entertainment game during entertainment game gameplay including skillful execution of the entertainment game, wherein the enabling element is an entertainment game gameplay limited resource utilized in the entertainment game by the player to advance the entertainment game gameplay; and communicate to the game world engine, the actions taken by the player of the utilization of the enabling element in the entertainment game during the entertainment game gameplay;

use the randomly generated payout of real world credits to alter subsequent entertainment game gameplay in the entertainment game; and the game world engine connected to the real world engine by the communication link, and connected to the entertainment software engine, wherein the game world engine is constructed to integrate simultaneous operation of the real world engine and the entertainment software engine by:

receiving from the entertainment software engine, the actions taken by the player of the utilization of the enabling element in the entertainment game during the entertainment game gameplay;

communicating to the real world engine via the communication link, the trigger to determine the randomly generated payout of real world credits, wherein the trigger is based on the actions taken by the player of the utilization of the enabling element in the entertainment game during the entertainment game gameplay;

receiving from the real world engine via the communication link, the randomly generated payout of real world credits;

correlating the randomly generated payout of real world credits with an accumulation of enabling elements for utilization by the player in the entertainment game during the entertainment game gameplay by:

determining a number of added enabling elements wherein the number of added enabling elements is scaled according to a scaling ratio relative to the randomly generated payout of real world credits;

dividing the added enabling elements according to a division ratio into enabling elements ascribed to the player and capable of immediate utilization by the player in the entertainment game during the entertainment gameplay and reserve enabling elements ascribed to the player but incapable of immediate utilization by the player in the entertainment game the entertainment game gameplay;

communicating to the entertainment software engine, the enabling elements ascribed to the player and capable of immediate utilization by the player in the entertainment game during the entertainment game gameplay;

determining that the player has achieved a predetermined accomplishment in the entertainment game during the entertainment game gameplay through skillful execution of the entertainment game;

communicating to the entertainment software engine the reserve enabling elements for immediate utilization by the player in the entertainment game during the entertainment game gameplay when it is determined that the player has achieved the predetermined accomplishment in the entertainment game; and displaying to the player the enabling elements and the reserve enabling elements on a user interface.

2. The electronic gaming machine of claim 1, wherein the game world engine is further constructed to determine the trigger to determine the randomly generated payout of real world credits in response to the player's utilization of an amount of enabling elements in the entertainment game during the player's skillful execution of the entertainment game.

3. The electronic gaming machine of claim 1, wherein the game world engine is further constructed to cap the total number of enabling elements at a specific number of enabling elements.

4. The electronic gaming machine of claim 1, wherein the enabling elements are soldiers in the entertainment game.

5. The electronic gaming machine of claim 1, wherein the enabling elements are bullets in the entertainment game.

6. The electronic gaming machine of claim 1, wherein the real world engine and the game world engine are constructed from different processing apparatuses, and wherein the game world engine and the real world engine are connected by a network.

7. The electronic gaming machine of claim 1, wherein the game world engine and the entertainment software engine are constructed from different processing apparatuses; and wherein the game world engine and the entertainment software engine are connected by a network.

* * * * *